US008454227B2

(12) United States Patent
Romano

(10) Patent No.: US 8,454,227 B2
(45) Date of Patent: Jun. 4, 2013

(54) INTERNAL BLOCKING DEVICE FOR PUSH BUTTONS OF A TIMEPIECE

(76) Inventor: Michele Romano, Massa E Cozzile (IT)

( * ) Notice: Subject to any disclaimer, the term of this patent is extended or adjusted under 35 U.S.C. 154(b) by 93 days.

(21) Appl. No.: 13/146,117

(22) PCT Filed: Feb. 18, 2010

(86) PCT No.: PCT/IB2010/050733

§ 371 (c)(1),
(2), (4) Date: Jul. 25, 2011

(87) PCT Pub. No.: WO2010/095108

PCT Pub. Date: Aug. 26, 2010

(65) Prior Publication Data

US 2011/0280111 A1 Nov. 17, 2011

(30) Foreign Application Priority Data

Feb. 23, 2009 (IT) ..... PT2009A0003

(51) Int. Cl.
*G04B 29/00* (2006.01)

(52) U.S. Cl.
USPC ..... 368/289; 368/319; 368/308

(58) Field of Classification Search
USPC ..... 368/286–290, 306–308, 319–321
See application file for complete search history.

(56) References Cited

U.S. PATENT DOCUMENTS

| | | | | |
|---|---|---|---|---|
| 8,092,077 | B2 * | 1/2012 | Hobor | 368/319 |
| 2010/0128575 | A1 * | 5/2010 | Okuda | 368/308 |
| 2010/0142333 | A1 * | 6/2010 | Hiranuma et al. | 368/319 |
| 2010/0220560 | A1 * | 9/2010 | Hiranuma et al. | 368/295 |
| 2010/0220562 | A1 * | 9/2010 | Hozumi et al. | 368/308 |
| 2011/0051564 | A1 * | 3/2011 | Hiranuma et al. | 368/147 |

FOREIGN PATENT DOCUMENTS

| | | |
|---|---|---|
| CH | 247039 | 2/1947 |
| CH | 304969 | 10/1970 |
| EP | 1345095 | 9/2003 |
| FR | 2775798 | 9/1999 |
| GB | 1074380 | 7/1967 |

OTHER PUBLICATIONS

English Abstract of FR2775798, Sep. 10, 1999.

* cited by examiner

*Primary Examiner* — Sean Kayes
(74) *Attorney, Agent, or Firm* — Preston Smirman; Smirman IP Law, PLLC

(57) ABSTRACT

In a watchcase of a time-piece an internal blocking device for simultaneously blocking the push-buttons (10, 20) of the timepiece comprises an internal collar (11, 21) for each push-button pressing a gasket (12, 22) thereof against the watch-case (30) and at least one sliding element (40) providing blocking members (41, 42) for blocking the movement of the push buttons (10, 20). The sliding elements (40) are operated from outside the timepiece through the wind/set crown (50), a specific screw down button, the bezel (60) or other external members of the timepiece. The internal push buttons blocking device of the invention improves watertightness of the time-piece by a simple and reliable mechanism which is very easy and rapid to use.

14 Claims, 4 Drawing Sheets

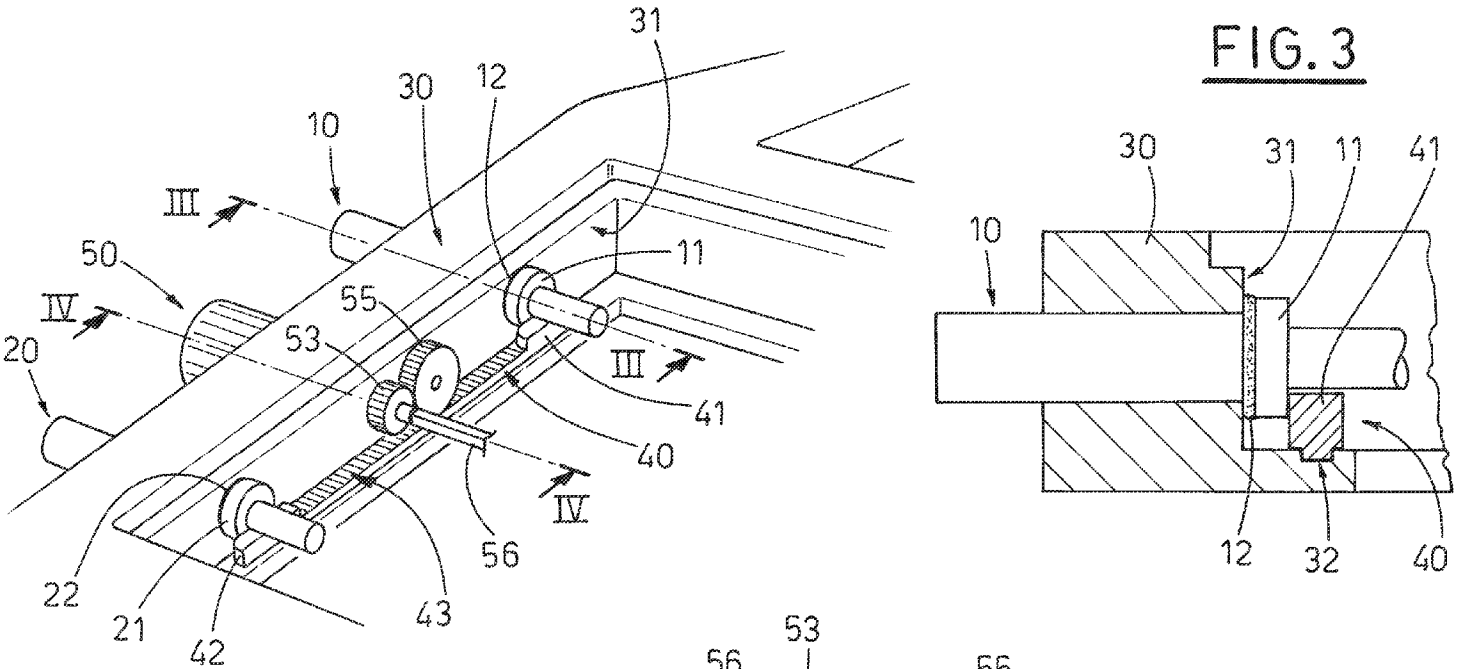
FIG. 3
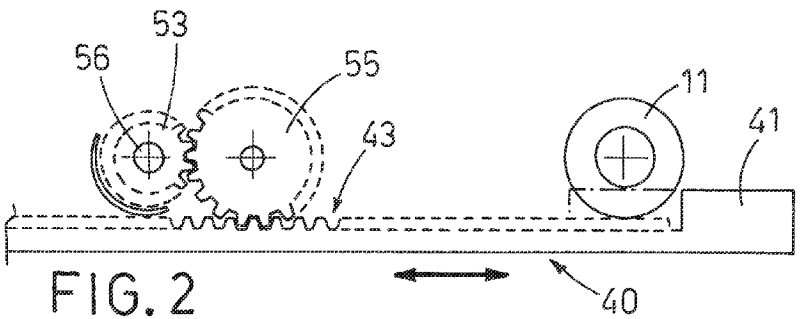
FIG. 2
FIG. 1

FIG. 4
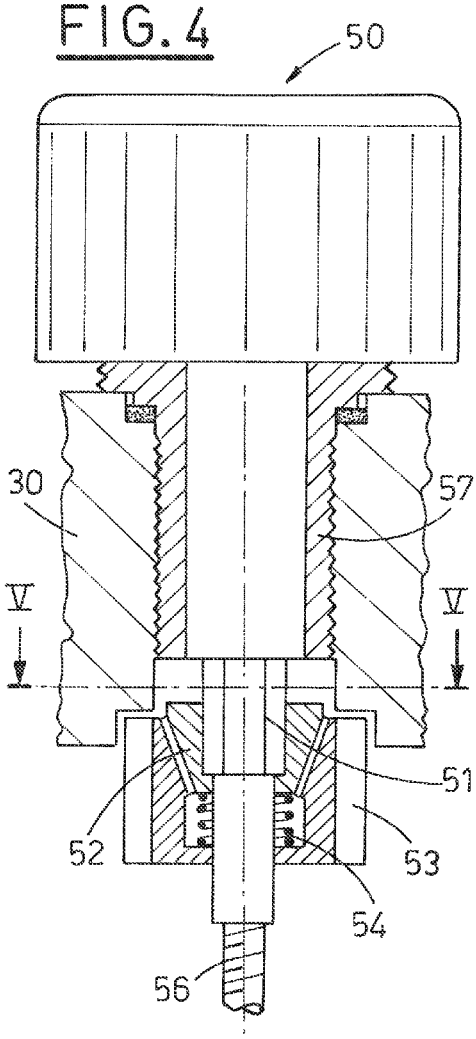
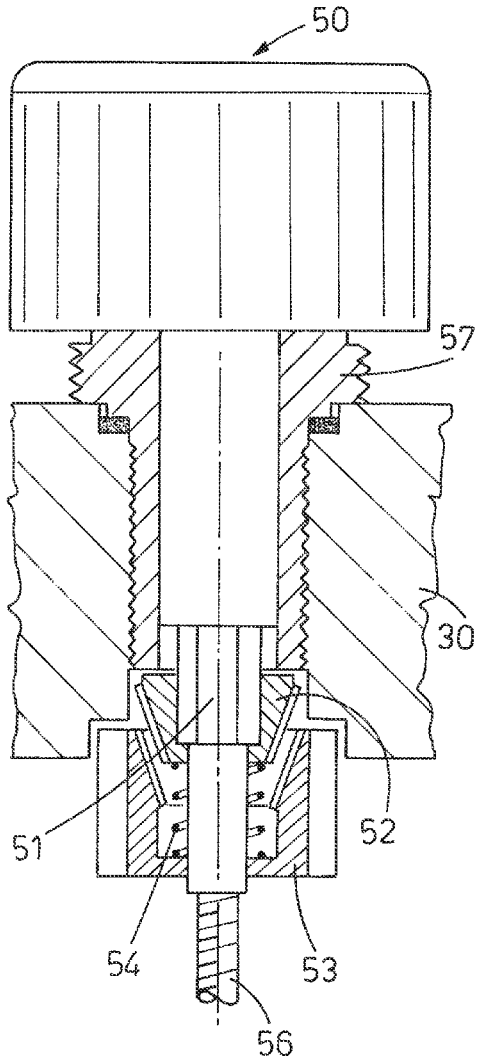
FIG. 6
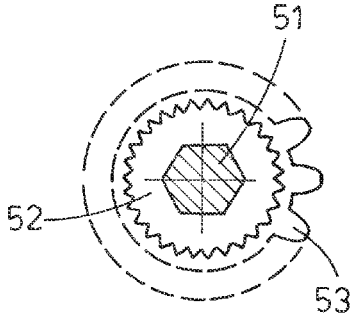
FIG. 5

INTERNAL BLOCKING DEVICE FOR PUSH BUTTONS OF A TIMEPIECE

CROSS-REFERENCE TO RELATED APPLICATION

The instant application is a national phase of International patent application number PCT/IB2010/050733, filed Feb. 18, 2010, which claims priority to IT PI2009A000003, filed Feb. 23, 2009, the entire specifications of all of which are expressly incorporated herein by reference.

FIELD OF THE INVENTION

The present invention concerns an internal device for blocking push buttons of a timepiece, in particular a chronograph watch, in order to prevent un-wanted activation of said push-pieces and to improve watertightness.

DESCRIPTION OF THE PRIOR ART

Chronograph functions of chronograph watches are usually controlled by two push buttons located at 2-o'clock and 4-o'clock, that is at both sides of the watch crown used to wind and set the watch.

In diver's watches the push buttons must have a waterproofing system in order to prevent damages to the watch mechanism.

Standard push buttons are provided with a stem which slides in an opening of the case or of a tube integral to the case and they are forced in position by elastic means. In this push buttons the waterproofing system mainly consists of a set of rubber gaskets and o-rings arranged between the head and/or the stem of the button and the opening of the case. In this case the waterproofing performances depends on the number and the efficiency of the gaskets but, anyway no waterproof features can be granted when the button is being pushed. As it is obvious, a fortuitous pressure on the push button when under water, or even the pressure of the water itself, may cause activation of the push button with serious damages to the watch mechanism.

To prevent the above they are known screw-down buttons which provide a thread surface for blocking the button by means of a corresponding thread externally provided in the case, or other tube element integral to the case. When the button is screwed to the case the button is prevented from being pushed so that waterproof features are safe. The above blocking system has two main limits. First of all screw-down push buttons are complicated and big sized so that they involve relevant production costs and they have aesthetic limits that render them not suitable for classic chronograph watches. In addiction, each push button has to be independently screwed to be blocked.

SUMMARY OF THE INVENTION

Main object of the present invention is to propose a locking device for push buttons of a timepiece, in particular a chronograph watch, able to overcome the above limits of the conventional chronograph push buttons.

Further object of the present invention is to propose a locking device for push buttons of a chronograph watch apt to prevent fortuitous movement of the push buttons.

Another object of the present invention is to propose a locking device for push buttons suitable to be used in any kind of chronograph watch, and with push buttons of any size and shape.

The above objects are attained by an internal blocking device for push buttons of a timepiece comprising:

- at least a push button to be blocked providing an inside collar which abuts an internal surface of a watchcase;
- a gasket or a o-ring interposed between said collar and said watchcase;
- at least one sliding element internal to said watchcase for sliding with respect to said push-buttons to be blocked, said sliding elements providing a block member for each push button to be blocked, said block members engaging said collar of a push button thereof upon sliding movement of said sliding element;
- drive means for controlling said sliding movement of said sliding element from outside said watchcase.

Advantageously said drive means are operated through the wind/set crown of said timepiece.

Preferably said wind/set crown is a screw down crown arranged so that when it is unscrewed to set the time said push buttons are unblocked and then blocked again when said wind/set crown is screwed again.

When operated through the wind/set crown the drive means comprises a pinion coaxial to the wind/set crown and operated by a rotary motion of the wind/set crown, said pinion transmitting movement to a rack-like portion of the sliding elements.

Advantageously the drive means comprises at least one driven gear interposed between said pinion and said rack-like portion of said sliding elements in order to reduce or improve the transmission ratio.

In a preferred embodiment the drive means comprises a conical gear engaging a mating internal conical gear of said pinion, a spring member housed inside said pinion for disengaging said bevel gear from said internal conical gear, said wind/set crown being provided with a portion shaped so as to transmit rotary motion to said conical gear.

Alternatively the drive means can be operated through the bezel of said timepiece.

In this last case the watchcase provides at least one slot made in its upper surface for receiving a pin fastened at one end to the bezel and at its opposite end to the sliding element.

Preferably, in order to have a watertight watchcase, a gasket, or two annular sealing elements are placed around said at least one slot between the bezel and the watchcase.

Advantageously the bezel is provided with a screw thread coupling with a corresponding screw thread of said watchcase.

Still advantageously the block members are hook-shaped members protruding from the sliding elements.

In most cases the push buttons to be blocked are in number of two placed at about 2-o'clock and 4-o'clock of the timepiece.

When the watchcase has internally a circular shape the said sliding element is advantageously an annular element.

The device of the invention clearly improve watertightness of timepieces as push buttons can be used only when necessary. In addiction, when under water, the push buttons cannot be activated by the water pressure. The blocking device of the invention blocks the push buttons from inside the watchcase and it can be operated from outside by using existing watch elements, that is the wind/set crown or the bezel. These last prevents overloading the external part of the watchcase with extra elements.

Furthermore the blocking device of the invention is very rapidly operated, both for blocking and for releasing the push buttons as it does not need to independently screw or unscrew each push button The push buttons do not need to be screw down buttons so that the external shape and size of the push buttons can be freely designed

BRIEF DESCRIPTION OF THE DRAWINGS

The above and more advantages of the device of the invention will be better understood by way of preferred embodiments examples, described in the following with reference to the accompanying drawings, in which:

FIG. 1 shows a portion of a perspective view of a watchcase where is mounted a blocking device according to the invention;

FIG. 2 shows a front view of the blocking device of FIG. 1;

FIG. 3 shows a section view taken along line III-III FIG. 1;

FIG. 4 shows a section view of a wind/set crown taken along line IV-IV of FIG. 1 comprising drive means of a blocking device according to the invention;

FIG. 5 shows a section view taken along line V-V of FIG. 4;

FIG. 6 shows a view similar to FIG. 4 where the wind/set crown and the drive means are in a different configuration;

DETAILED DESCRIPTION OF PREFERRED EMBODIMENTS

Figure 7:
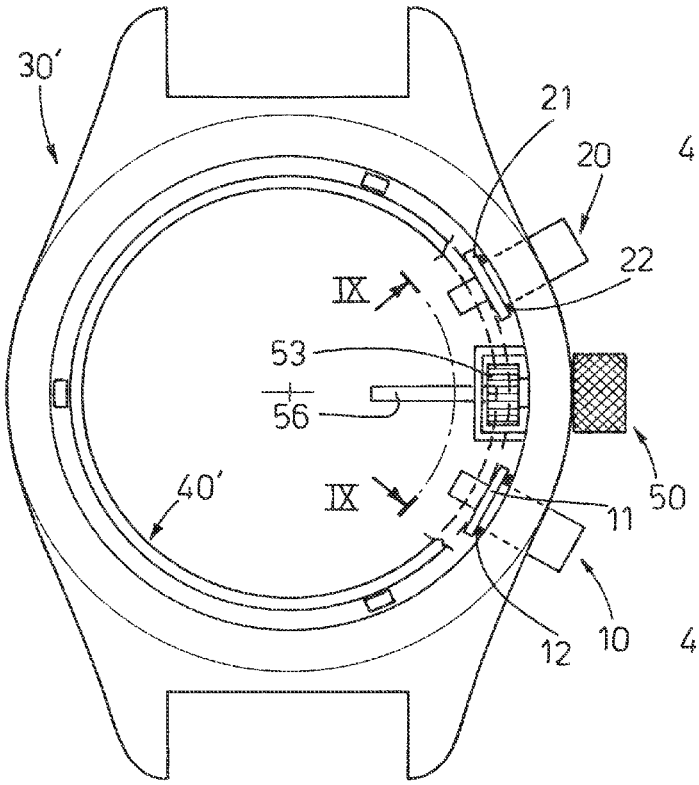
FIG. 7 shows a bottom view, in partial broken view, of a watchcase comprising a different embodiment of the blocking device of the invention.

Referring first to FIGS. 1 to 6 is shown a first embodiment of the invention in which a blocking device for blocking the chronograph function controlling push-buttons, 10, is mounted in a square shaped watchcase, 30. The push-buttons 10 and 20 are provided with an internal collar, 11, 21, which is larger than the push-button housing hole of the watchcase and the collar 11, 21 abuts against the internal surface, 31, of the watchcase. A gasket or o-ring, 12, 22, is interposed between the collar 11, 21 and the internal surface 31 of the watchcase 30 and assures watertightness when the collar 11, 21 presses against the internal surface 31 of the watchcase 30. A straight sliding element, 40, is housed in a groove, 32, made in the bottom internal surface of the watchcase 30, and it is able to slide in it. The sliding element 40 is provided with protruding blocking members, 41, 42, that, when the sliding element 40 is in its push-button blocking position, press the collars 11, 21 against the internal surface 31 of the watchcase 30. The sliding element 40 is driven to slide in the groove 32 from a push-button blocking position to a push-button release position upon rotary motion of the wind/set crown 50 of the timepiece. According to a specific embodiment of the invention the wind/set crown 50, has an end portion, 51, shaped with an hexagonal external section which gears with a correspondent internal section of a conical gear, 52. The conical gear 52 engages an internal conical gear of a pinion, 53. Inside the pinion 53 is housed a spring, 54 working between a bottom internal surface of the pinion 53 and the conical gear 52. The pinion 53 engages a driven gear, 55, which further engages a rack-like portion, 43, of the sliding element 40. The wind/set stem, 56, is connected to the crown 50 in a conventional way, and the wind/set crown 50 is connected to a housing tube, 57, in a conventional way as well. When the wind/set crown 50 is rotated the transmission mechanism above described makes the sliding element 40 slide from the push-button blocking position to the push-button release position and vice-versa.

As shown in FIG. 6, when the wind/set crown 50 is unscrewed or pulled out for winding or setting the time the spring 54 pushes the conical gear 52 away and it disengages from the internal conical gear of the pinion 53. In this last configuration the rotary movement of the wind/set crown 50 is no more transmitted to the sliding element 40.

Figure 9:
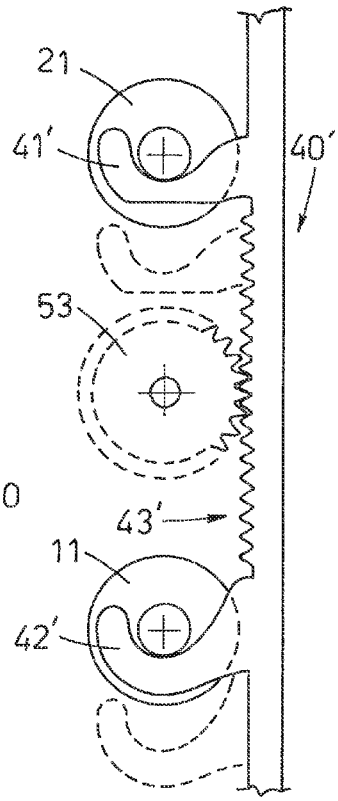
FIG. 9 shows a section view taken along the curved line IX-IX of FIG. 7.
Figure 8:
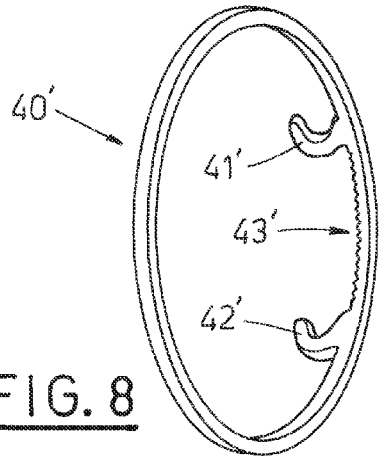
FIG. 8 shows a component of the blocking device of FIG. 7.

Referring to FIGS. 7 to 9 a different embodiment of the invention applies to timepieces, i.e. wrist watches, having a substantially circular shape. In particular, the internal profile of the watchcase, 30', is circular and it houses an annular sliding element, 40', shown in FIG. 8. The external diameter of the annular sliding element 40', corresponds to the internal diameter of the watchcase 30', so that it slides (rotates) on the internal surfaces of the watchcase 30' with its central axis coincident with a central axis of the watchcase and it does not need restraining elements such as the groove 32 of the previous embodiment. The sliding member 40' has two hook shaped block members, 41', 42' and between them there is a rack-like portion, 43', engaging the pinion 53. The pinion 53 is rotated by rotating the crown 50 thanks to the mechanism shown in FIGS. 4 to 6.

Figure 10:
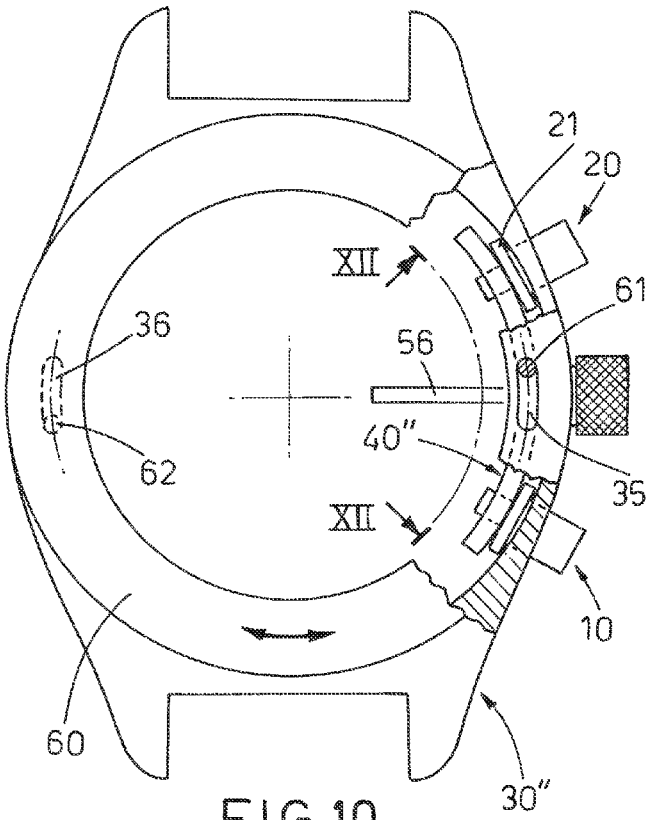
FIG. 10 shows a top view of watchcase, in partial broken view, of a watchcase comprising a further embodiment of the blocking device of the invention.
Figure 12:
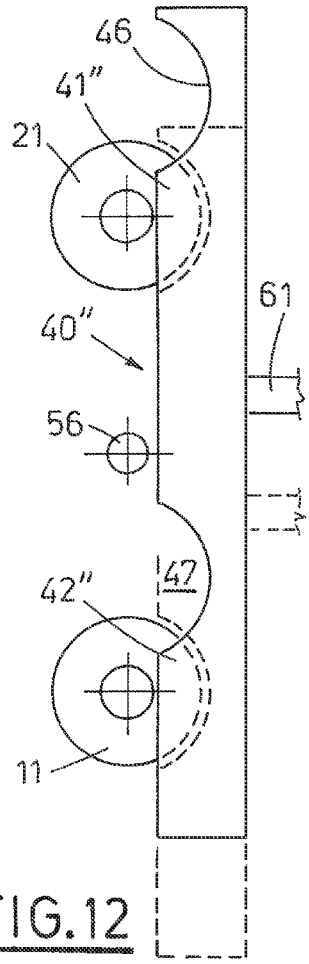
FIG. 12 shows a section view taken along the curved line XII-XII of FIG. 10.
Figure 11:
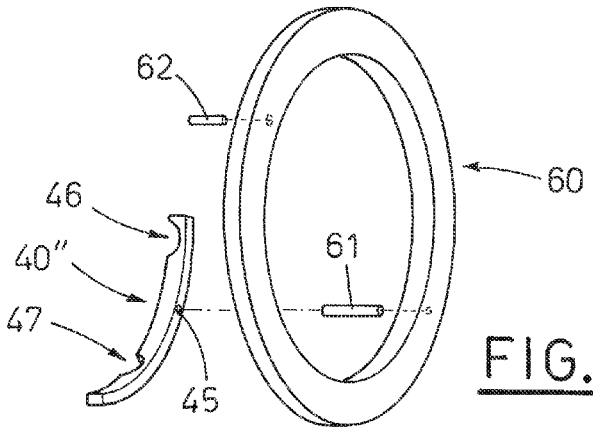
FIG. 11 shows an exploded view of some components of the blocking device of FIG. 10.

Referring to FIGS. 10 to 12 a third embodiment is shown in which the blocking device is operated by rotating a bezel, 60, of the timepiece. In a watchcase, 30", are made two slots, 35, 36, having a center of curvature corresponding to the center of the bezel 60. A pin, 61, connects the bezel 60 with a sliding element, 40", passing through the slot 35. A second pin 62 passes through the other slot 36 and can be connected to an element apt to prevent the pin 62 disengaging the slot 36. The sliding element 40" has a hole, 45, for receiving the pin 61 and two recesses, 46, 47, that define the push-button release position when they are positioned in correspondence to the collars 12, 22. In this embodiment blocking members, 41" and 42" are defined by non recessed portions of the sliding element 40". The bezel 60 is able to rotate of a little angle between two opposite end positions of the pins 61, 62 in the slots 35, 36 respectively. The rotation of the bezel 60 causes the sliding movement of the sliding element 40" operated by the pin 61. So, a first end position of the pin 61 corresponds to the push-button blocking position and the opposite end position of the pin 61 corresponds to the push-button release position.

The bezel 60 could be safely fastened to the watchcase 30" by providing a threaded surface in the inner portion of the bezel and a corresponding threaded surface in the upper surface of the watchcase 30". Moreover, to assure watertightness of the watchcase 30" gaskets or o-rings could be provided around or at sides of the slots 35, 36 to be pressed between the bezel 60 and watchcase 30".

It is clear that further embodiments of the invention could be provided and many changes or modifications could be carried out on the blocking device of the invention.

The external button that operates the drive means which move the sliding element could be other than the wind/set crown 50. The wind/set crown 50 and the push-buttons 10, 20 can be of any shape and size and they could be provided with more gaskets and/or o-rings arranged in a conventional way to improve watertightness. In particular the wind/set crown 50 could be a screw down crown as well as a standard crown.

The drive means that operates the sliding element upon rotary motion of the crown could be simplified. For instance, the hexagonal end portion 51 of the crown 50 could be directly connected to a correspondent internal shape of the pinion 53.

Different drive means could be provided for driving the sliding element from outside the timepiece through an existing external member of the timepiece as well as through specifically intended members.

The collars 11, 21 and as a consequence the blocking members 41, 42 could have a different shape. The collars must be greater in size than the aperture of the watchcase that houses the push-button and they could have whatever shape suitable to press a gasket or an o-ring against the internal surface of the watchcase. The blocking members must have a shape allowing them to abut the collar thereof when the device is in the push-button blocking position. The blocking elements could also be provided with a slope surface for making easier them to engage the collars.

The sliding element has to be restrained in a way suitable to let it slide inside the watchcase with respect to the push-buttons to be blocked. The restraining means could be simply the shape of the sliding element together with the shape of the case, as shown in FIGS. 7 to 9, as well as specific restraining means could be provided.

These and more changes and modifications could be carried out on the device of the invention still keeping safe the above disclosed advantages and remaining within the ambit of protection of the following claims.

In fact, the above disclosure of specific embodiments is useful to understand the field and scope of the present invention, so that people skilled in the art is able to put it into practice by modifying and adapting the above disclosed embodiments; such modifications will be then considered as equivalent of the disclosed embodiments. The numbers and terminology used are to be intended merely for disclosure and for comprehending the scope of the invention and then they do not limit the invention.

The invention claimed is:

1. An internal blocking device for push buttons of a timepiece, comprising:

at least one push button to be blocked providing a collar which abuts an internal surface of a watchcase;

a gasket or an o-ring interposed between said collar and said watchcase;

at least one sliding element internal to said watchcase for sliding with respect to said push-buttons to be blocked, said sliding elements providing a block member for each push button to be blocked, said block members engaging said collar of a push button thereof upon sliding movement of said sliding elements; and a drive system for controlling said sliding movement of said sliding elements from outside said watchcase.

2. The internal blocking device for push buttons of a timepiece according to claim 1, wherein said drive system is operated through a wind/set crown of said timepiece.

3. The internal blocking device for push buttons of a timepiece according to claim 2, wherein said wind/set crown is a screw down crown arranged so that when it is unscrewed to set the time, said push buttons are unblocked and then blocked again when said wind/set crown is screwed again.

4. The internal blocking device for push buttons of a timepiece according to claim 2, wherein said drive system comprises a pinion coaxial to said wind/set crown and is operated by a rotary motion of said wind/set crown, said pinion transmitting movement to a rack-like portion of said sliding element.

5. The internal blocking device for push buttons of a timepiece according to the claim 4, wherein said drive system further comprises at least one driven gear interposed between said pinion and said rack-like portion of said sliding element.

6. The internal blocking device for push buttons of a timepiece according to claim 5, wherein said drive system further comprises a conical gear engaging a mating internal conical gear of said pinion, a spring member housed inside said pinion for disengaging said conical gear from said internal conical gear, said wind/set crown being provided with a end portion shaped so as to transmit rotary motion to said conical gear.

7. The internal blocking device for push buttons of a timepiece according to claim 1, wherein said drive system is operated through a bezel of said timepiece.

8. The internal blocking device for push buttons of a timepiece according to claim 7, wherein said watchcase provides at least one slot made in its upper surface for receiving a pin fastened at one end to said bezel and at its opposite end to said sliding element.

9. The internal blocking device for push buttons of a timepiece according to claim 8, further comprising a gasket placed around said at least one slot between said bezel and said watchcase.

10. The internal blocking device for push buttons of a timepiece according to claim 8, further comprising two annular sealing elements interposed between said bezel and said watchcase at opposite sides of said at least one slot.

11. The internal blocking device for push buttons of a timepiece according to claim 7, wherein said bezel is provided with a screw thread coupling with a corresponding screw thread of said watchcase.

12. The internal blocking device for push buttons of a timepiece according to claim 1, wherein said block members are hook-shaped members protruding from said at least one sliding element.

13. The internal blocking device for push buttons of a timepiece according to claim 1, wherein said push buttons (10, 20) to be blocked are placed at about the 2-o'clock and 4-o'clock positions of said timepiece.

14. The internal blocking device for push buttons of a timepiece according to claim 1, wherein said watchcase has internally a circular shape and said sliding element is an annular element.

* * * * *